US006161605A

United States Patent [19]

Pena

[11] Patent Number: 6,161,605

[45] Date of Patent: Dec. 19, 2000

[54] FOLDABLE DEVICE AND METHOD FOR PROTECTING DOUBLE-HUNG WINDOWS

[76] Inventor: Martin R. Pena, 11039 Painted Tree Rd., Charlotte, N.C. 28226

[21] Appl. No.: 09/211,071

[22] Filed: Dec. 14, 1998

[51] Int. Cl.[7] ..... A47H 1/00

[52] U.S. Cl. ..... 160/90; 160/105; 160/107; 160/181; 160/368.1; 49/62; 49/463; 52/203

[58] Field of Search ..... 160/90, 105, 10.7, 160/18.1, 18.2, 23, 36.9, 370.21, 368.1, 368.2; 49/61, 62, 463; 52/203

[56] References Cited

U.S. PATENT DOCUMENTS

| | | | |
|---|---|---|---|
| D. 331,211 | 11/1992 | Harris . | |
| 773,330 | 10/1904 | Lunken | 160/107 |
| 1,679,443 | 8/1928 | Olson et al. | 160/370.21 |
| 2,127,871 | 8/1938 | Kozloff | 160/181 |
| 2,320,125 | 5/1943 | Goldmerstein | 160/368.1 |
| 2,489,901 | 11/1949 | Kocinski | 160/370.21 |
| 2,598,610 | 5/1952 | Staz et al. | 49/463 |
| 2,643,710 | 6/1953 | Sylvan | 160/90 |
| 2,692,016 | 10/1954 | Camerino | 160/90 |
| 2,742,679 | 4/1956 | Young | 49/463 |
| 3,762,119 | 10/1973 | Sowle | 49/62 |
| 3,836,187 | 9/1974 | Buettner . | |
| 3,948,308 | 4/1976 | Facey . | |
| 4,406,320 | 9/1983 | Bingham | 160/370.21 |
| 4,468,886 | 9/1984 | Tew | 49/61 |
| 4,848,825 | 7/1989 | Niernberger . | |
| 5,192,244 | 3/1993 | Rose | 49/463 |

FOREIGN PATENT DOCUMENTS

| | | | |
|---|---|---|---|
| 62074 | 3/1944 | Denmark | 49/61 |
| 637349 | 9/1963 | France | 49/463 |

*Primary Examiner*—Blair M. Johnson
*Attorney, Agent, or Firm*—Dorothy S. Morse

[57] ABSTRACT

An aesthetically-pleasing foldable, reusable security device and method for protecting double-hung windows from storm debris hazards and vandalism, wherein the perimeter edges of the device fit within the outermost groove of a double-hung window frame and can be easily installed and removed by one adult of ordinary strength and coordination standing behind the window. The device also protects the building against unauthorized entry and burglary, and is particularly useful for protecting upstairs windows since it requires no pre-installation steps or hardware, no professional installation, no tools, no ladder, and its installation does not permanently alter or damage the window or adjacent building surfaces. The device has at least two protective panels with two or more hinges attached between the front surfaces of adjacent panels which allow them to fold substantially parallel to one another in a compact configuration for storage, and unfold again into an essentially planar configuration for use. Straps are attached to the back surfaces of the two endmost panels, drawn around the window sashes and secured by them against the outer window frame, and then pulled taut behind the closed and locked sashes with a quick-release fastener. The protective panels may be transparent, translucent, or opaque, depending on the homeowner's preference or need, and the straps and panels can be color coordinated and can comprise decorative designs for enhanced aesthetic appeal. Also, the panels may optionally contain reinforcing bars, resilient edging and bullet-proof materials, one-way heat transfer materials, corrosion-resistant films, and multiple-layered panel construction.

18 Claims, 8 Drawing Sheets

FIG. 2
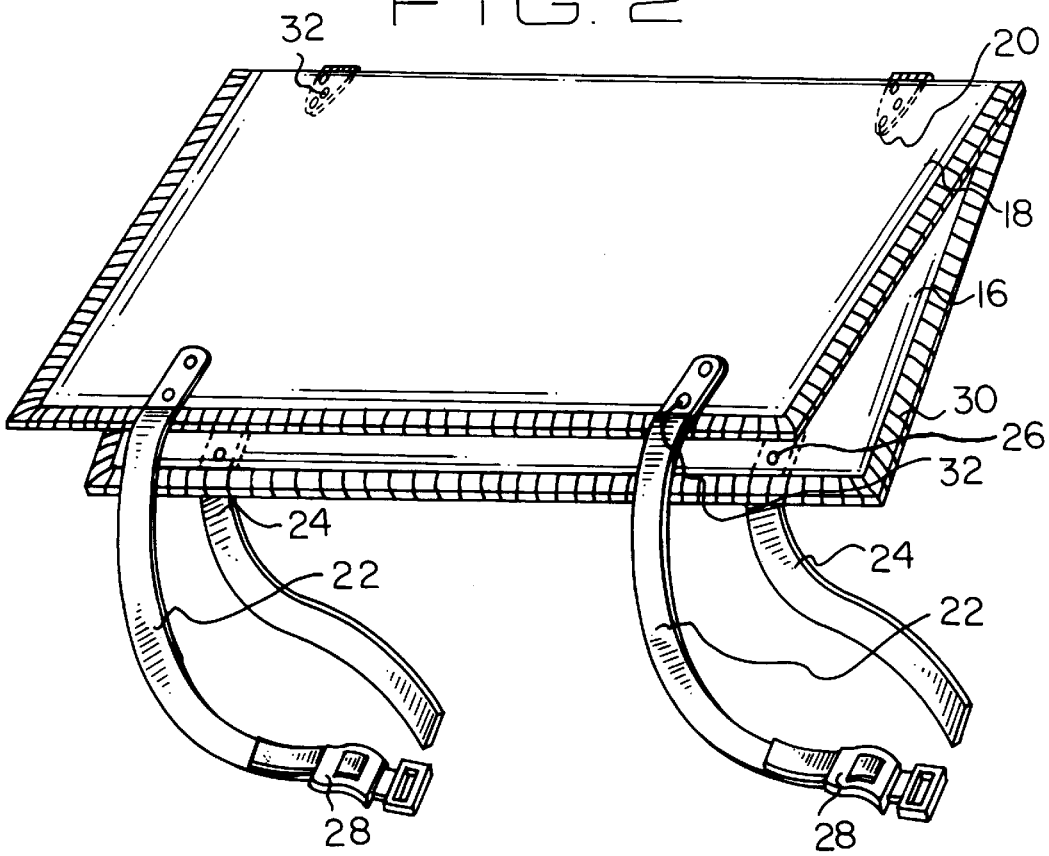
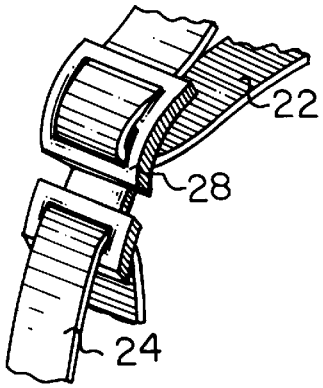
FIG. 3
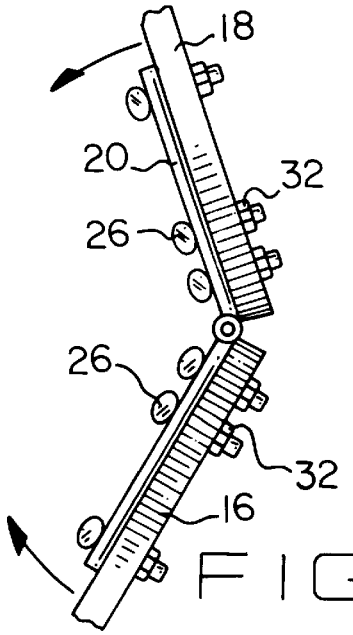
FIG. 4

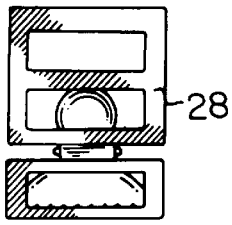
FIG. 5
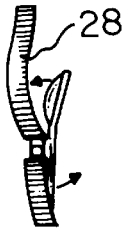
FIG. 6
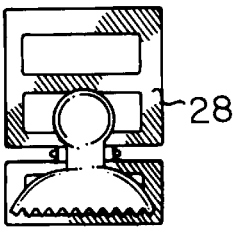
FIG. 7
FIG. 8
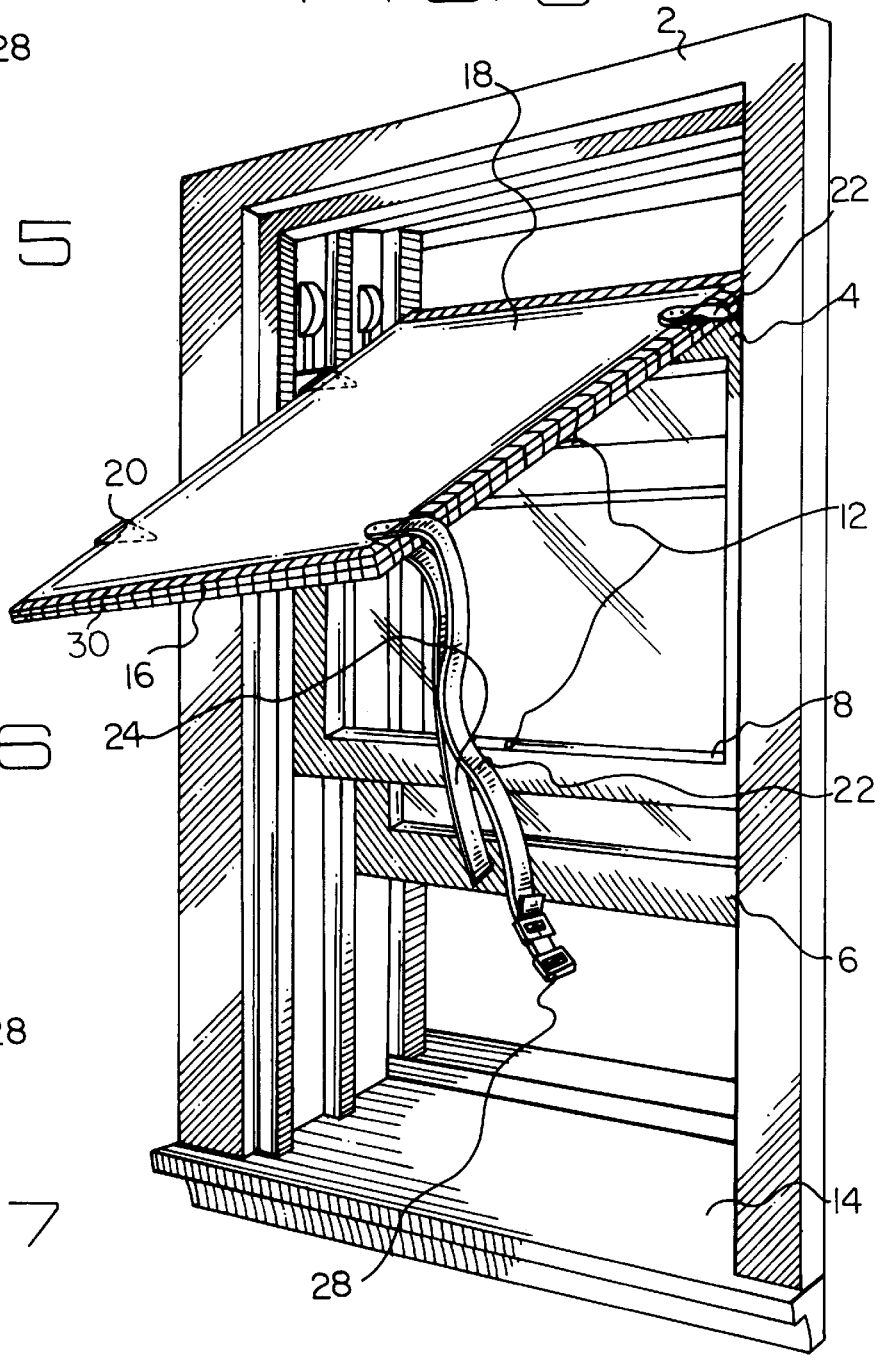

FIG. 10
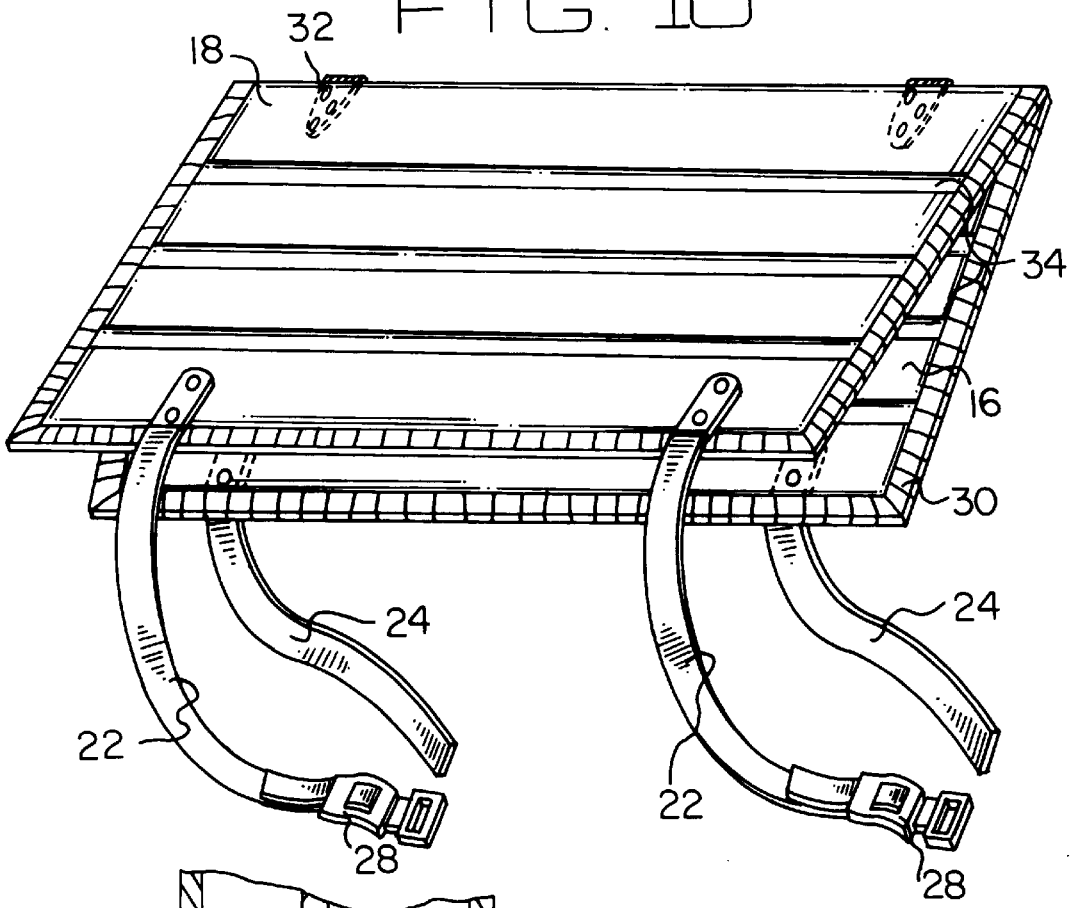
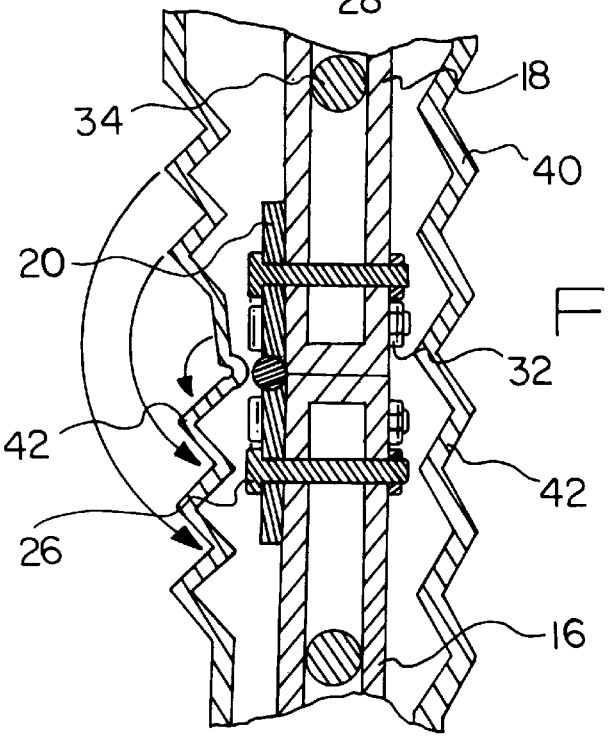
FIG. 11

FOLDABLE DEVICE AND METHOD FOR PROTECTING DOUBLE-HUNG WINDOWS

BACKGROUND

1. Field of Invention

This invention relates to protective devices for windows, specifically a reusable multiple-panel, foldable security device and method for protecting double-hung windows with the perimeter edges of the device fitting within the outermost groove of a double-hung window frame and having a plurality of opposing straps attached thereto which are drawn rearward both over and under the double-hung window sashes during installation. The opposing straps connect taut behind the closed and locked double-hung window sashes to secure the protective panels in place so that the security device cannot be easily removed by someone attempting to do so from the outside of the building. The aesthetically pleasing device is made from lightweight materials and in most instances can be easily installed and removed by one adult of average strength and coordination standing behind the double-hung window without the use of a ladder or tools. Also, installation of the security device of the present invention does not damage or cause permanent alteration of the double-hung window frame or the building surfaces adjacent to the window. Applications can include, but are not limited to, protecting a double-hung window from hazards such as storm debris, vandalism, burglary, and unauthorized entry.

BACKGROUND

2. Description of Prior Art

People continually look for easy and affordable ways to protect their homes and families from hazards associated with adverse environmental conditions, vandalism, and household entry by unauthorized persons. The windows of a house are likely to be the one part of a house most vulnerable to such hazards. High winds experienced during hurricanes, tornadoes, and typhoons can put houses and their windows at risk for damage from airborne debris. Historically, wooden shutters were pivotally mounted adjacent to building windows and closed as necessary over the window glass to protect it from storm damage, as well as secure the windows against unauthorized entry. However, while decorative shutters are still popular, functional shutters seem to be generally disfavored in modern architecture. Multiple-bladed rolling shutter systems, particularly those with automatic drive mechanisms, are an alternative to traditional wooden shutters and can be installed over windows as an effective way protect them against storm damage and intruders, however such shutter systems are expensive and usually require professional installation and maintenance.

Window protection needed against the hazard of storm debris requires a few considerations that are different from window protection used to avoid damage from vandalism and unauthorized entry. People in areas where tornadoes can be quickly spawned are usually given little or no advance warning of their arrival. As a result, any system protecting windows from tornado damage must be automatically engaged by a computer-aided home monitoring system at the first detection of increased wind velocity above a predetermined minimum velocity level, or if they are manually installed or engaged, window protection devices must already be positioned in front of the window sashes before any storm capable of producing tornadoes begins. One option would be to leave manually installed or manually engaged window protection devices in place during an entire spring or summer season in which one would expect enhanced tornado activity. However, homeowners would disfavor use of any window protection devices that detracted from the outward appearance of their homes, significantly blocked light entry into the home, or devices that blocked efficient egress from the home during emergencies.

In contrast, the arrival of hurricanes and typhoons are more accurately predicted than tornadoes and homeowners are usually given some time to prepare for their arrival. Therefore, the options used for window protection against hurricane and typhoon generated storm debris are more diverse. Homeowners who have installed window protection systems which require manual operation would have time to engage them. Other homeowners would have time to nail plywood over windows or place various types of adhesive-backed tape directly onto window glass. Installed systems are more expensive than the present invention and the use of plywood and tape both have significant disadvantages which are overcome by use of the present invention. For example, covering a window with plywood requires advanced planning, as it takes time to purchase the plywood, transport it to the needed site, measure it, cut it, and nail it into position. The present invention can be installed much faster. Also, installing plywood over a window requires tools and usually a ladder, particularly when upper story windows are involved. The present invention requires no tools and no ladder for an adult of average strength and coordination. Furthermore, plywood is heavy, and handling it may require more than one person, one person to hold large pieces of plywood in place over a window while a second person nails the wood to the window's frame or adjacent building surface. With the present invention, one adult of average strength and coordination can generally install it unless unusually windy conditions are present. Also, the installation of plywood over a window makes the window temporarily unusable. Aside from blocking entry of all light through a window, since plywood is installed against the outside of a building it is difficult to use the window as a means of egress during emergencies. The present invention can be made transparent or translucent to allow light to enter the building and its quick-release buckles that are easily accessible from the inside of the building allow for fast egress in emergencies. Furthermore, if not nailed skillfully, plywood can come loose during a storm whereby its protective capability becomes diminished or non-existent, and if it further becomes totally separated from the building it is likely to become a wind-borne projectile that could cause significant injury to other objects and people. The present invention has three design features which keep its protective panels securely in place, the panel edges fitting into the outermost groove in the outer frame of the double-hung window, the straps being held against the outer frame by the closed and locked upper and lower window sashes, and the straps which are connected taut behind the window sashes. Also, if the present invention were removed and allowed to fall to the ground during a storm for emergency egress through the window, its folding configuration and straps would reduce the likelihood of it becoming a wind-borne projectile. In addition, the installation of plywood over windows detracts from the aesthetic appearance of a house and as a result of being nailed directly to the outside of a building, it can be more readily removed by an intruder. The present invention does not detract from the appearance of a building and can have surface decorations on both its straps and panels which coordinate with the decor of a building. It is also made from shatter-resistant and impact-resistant materials and it cannot be readily removed by an intruder since the perimeter edges of its panels are inserted within the outermost groove of a double-hung window frame. The installation of plywood also places nail holes in a window's frame or adjacent building structure, and if plywood is repeatedly installed and removed from a building, the building will ultimately become damaged to the point that it will require repair. Installation of the present invention does not permanently alter window frames or any building surface adjacent to a window. Further, the use of plywood is not usually a cost effective means of window protection. Many homeowners only use it once or twice as they do not have adequate storage space for the bulky plywood pieces between storms or storm seasons. The present invention is easily reusable with minimal or no refurbishment between uses and it can be compactly folded for storage in a convenient location near to the window it is used to protect, such as under a bed or in a closet. The use of adhesive-backed tape directly on window panes also has disadvantages in that it is time consuming to install, it is messy to remove if the adhesive remains stuck on the glass surfaces during removal attempts, and it offers no significant protection against glass breakage. Since tape acts mainly to reduce glass dispersion upon breaking, it is likely that the window glass protected by adhesive-backed tape during hurricanes and typhoons would crack or break. Even if the glass is not dispersed, the interior of the building would still remain vulnerable to wind and rain related damage, as well as a target for vandals, particularly if the building was vacant when the window broke and a period of time elapsed prior to repair. The present invention is easy to install and remove, and it protects window sashes from breakage, as well as vandals and unauthorized entry.

The type of window protection needed to provide added security against vandals and intruders requires yet another set of considerations. Many homeowners use alarms and remote electronic monitoring systems for such purposes. While such systems are effective at reducing unauthorized entry into a house, both are expensive and do nothing to prevent the random acts of vandalism prevalent in some neighborhoods. A stray rock thrown through a window will set off an alarm which is likely to scare away a vandal, however, the window so damaged will still require a repair expense. Also, the broken window leaves the building vulnerable to storm damage, as well as a target of vandals and unauthorized entry prior to its repair. Some homeowners in particularly dangerous neighborhoods have chosen to use permanently installed window security bars to protect their homes from intruders. However, permanently installed window bars are expensive and sometimes cause fatalities during home fires when the barred windows prevent occupants from rapidly escaping.

Thus the reusable, lightweight, and transparent window covering of the present invention, which is both rapidly and easily installed and removed in most instances by one non-professional adult of ordinary strength and coordination but which resists removal by someone attempting to do so from the outside of the home and does not damage or permanently alter the window frame or building surfaces adjacent to the window, would provide a comprehensive solution for window protection from various environmental and criminal hazards. None of the window coverings currently available to homeowners provide all of the advantages of the present invention. While prior art window coverings do provide protection from environmental and criminal hazards, some are cumbersome to install and others require a variety of installation tools. Also, most must be installed and removed from the outside of the building and require the use of a ladder, particularly for upstairs windows. Further, while effectively protecting a window from outside hazards, some window coverings are less desirable than the present invention since they would not be easily removable during emergencies where a hasty exit through a window would be required. In addition, the present invention is simple to manufacture, it can be made from relatively inexpensive materials including recycled materials, it does not detract from the exterior appearance of the building when installed, it can comprise reinforcing bars for additional strength, its compact folded configuration makes it easy to store, and its straps allow it to remain securely in place during use while the quick-release strap fasteners simultaneously allow for quick egress through the window in emergencies.

The prior art thought to be most closely related to the present invention is the invention disclosed in U.S. Pat. No. 3,948,308 to Facey (1976). The Facey invention provides a foldable storm window or screen that has at least two rectangular panels that are joined together to form a structure larger than the window intended for protection. Each panel has a two-frame construction with the inner frame having brackets attached to it to which a pair of turnbuckles can be connected. The Facey invention also has resilient padding on the back perimeter of its outer frame to allow for irregularities in the building surface against which it will be placed, with its rectangular panels being made from thin pliable plastic, glass, or screen materials. The present invention differs from the Facey invention in that the present invention contemplates being positioned within the outermost groove of a double-hung window frame, not flat against the wall of the building adjacent to the window. Also, the present invention does not have a two-frame construction, brackets, or turnbuckles. Further, each of the rectangular panels in the Facey invention have a single turnbuckle connected behind it, while each of the opposing straps of the present invention extends across the rear surface of every connected foldable panel. As a result, the quick release of a few strap-connecting fasteners in the present invention would allow more rapid emergency evacuation of a building than a Facey invention having two or more turnbuckles, as even a few seconds longer delay in releasing the additional turnbuckles could mean the difference between a successful emergency escape and tragic consequences. Further, the present invention contemplates use of impact-resistant materials, including bullet-proof materials, as well as reinforcing bars, to protect a double-hung window from vandals and intruders, functions that the thin plastic, glass, and screen materials of the Facey invention would not be able to accomplish.

SUMMARY OF INVENTION

3. Objects and Advantages

The primary object of this invention is to provide a window protection device that is simple to use and can be removably secured within the outermost groove of a double-hung window frame by one adult of ordinary strength and coordination working from within the interior of a building so as to protect the window from such hazards as storm debris, vandalism, and entry by unauthorized persons. A further object of this invention is to provide a protective device for double-hung windows that is reusable and made from materials that will effectively protect windows from exposure to environmental elements for extended periods of time without undue deterioration itself from such elements. It is also an object of this invention to provide a protective device for double-hung windows that is lightweight and can be easily installed over both upstairs and downstairs windows without the use of tools or a ladder. A further object of this invention is to provide a protective device for double-hung windows that can be easily removed by the occupants of a building for quick evacuation through the window during emergencies but will otherwise remain securely in place as long as it is needed for window protection. It is also an object of this invention to provide a protective device for double-hung windows that when installed will not damage or permanently alter any portion of the window, window frame, weather-stripping around the window, or the building surfaces adjacent to the window. A further object of this invention is to provide a protective device for double-hung windows that can be folded into a compact configuration when not in use for easy storage within a readily accessible location, such as in a nearby closet or under a bed. It is also an object of this invention to provide a protective device for double-hung windows that requires little or no refurbishment between uses. A further object of this invention is to provide a protective device for double-hung windows that is sufficiently simple in design for inexpensive manufacture so it can be affordably priced for widespread homeowner use. It is a further object of this invention to provide a protective device for double-hung windows that can easily accommodate alternative materials to diversify its use, such as those materials which would make the protective device bullet-proof or one-way thermally conductive, or materials which would decoratively enhance the outer and inner surfaces of the protective panels.

As described herein, properly manufactured and properly installed, the present invention would provide a folding, multiple-panel device the edges of which can become secured within the outermost groove of a double-hung window frame so that the device can protect window sashes positioned behind it from damage due to wind, rain, vandalism, and unauthorized entry. The device could similarly protect horizontally sliding window sashes, provided a groove was present in the outer frame in front of the sash tracks for insertion of the protective panel perimeter edges. The device comprises at least two protective panels hinged together on their outside front surfaces which allows the protective panels to be easily folded and unfolded during both installation and removal of the device from its protective position. One embodiment of the present invention contemplates the protective panels being sandwiched between thinly-profiled outside panels which have centrally positioned accordion-type folds that facilitate the bending of each outside panel around the protective panels so that they all can be compactly folded together, with the thin outside panels functioning to protect the hinges and heads of the strap-connecting bolts from exposure to deteriorating elements, as well as protect the threaded end of the bolts and keep them from injuring people installing or removing the present invention, or scratching the paint on the window sashes or outer window frame. The edges of the protective panels may also have a resilient covering to keep them from scratching the installer or paint.

Each protective panel in a bi-folded embodiment of the present invention, or each of the two endmost protective panels in a series of three or more connected protective panels, has straps bolted to its inside back surface near the perimeter edge opposed to its hinged edge. The straps can be used as handles to facilitate the maneuverability of the protective panels during their installation, removal from a double-hung window frame, and transport between installation and storage sites. In one of the final steps of installation, the straps are each secured behind the window sashes to an opposing strap by use of a quick-release fastener, such as a clamping buckle. At the beginning of installation of the present invention in front of the panes of a double-hung window, the upper and lower window sashes are moved away from the outer frame toward the center of the window to create top and bottom openings. The entire present invention device is then inserted through the newly created top opening with the upper protective panel being positioned above the lower protective panel. The upper straps are then drawn rearward through the newly created top opening after which the lower protective panel is allowed to unfold so that the surface of the protective panels connected to the straps becomes positioned adjacent to the window glass. The upper window sash is then moved in an upward direction toward the outer frame and closed against the adjacent portion of the outer frame with the upper straps fixed therebetween and the upper edge of the upper protective panel positioned within the outermost groove of the outer frame. The lower straps are pulled through the newly created bottom opening under the lower window sash and inserted through the bottom-most rectangle of the clamping buckle, to connect the distal ends of opposed straps in each pair of straps to one another behind the window sashes with adjacent pairs of straps becoming essentially parallel to one another, after which the device is allowed to become centered in front of the double-hung window sashes with the edges of both its upper and lower protective panels becoming positioned within the outermost groove of the outer frame. The lower window sash is then moved in a downward direction and closed against the lower straps to fix the lower straps between the lower window sash and the outer frame. Opposing straps are then pulled taut to further secure the protective panels in place. The straps help to maintain the protective panels in their optimal positions during use and resist removal of the protective panels by anyone attempting to do so from the outside of the building. The protective panels are made from a durable, shatter-resistant material such as acrylic to provide an appropriate balance of a lightweight material that also has good abrasion resistance and impact strength. The protective panels can be transparent, translucent, or opaque, and may even contain surface decoration, depending on the homeowner's preference. The straps can also have surface decoration and be color coordinated to the decor of a room.

Since the installation is accomplished from the inside of a building, the present invention can usually be easily and rapidly installed over upstairs and downstairs windows by a single adult of average strength and coordination without the use of tools or a ladder. However, during windy conditions two people may be required to unfold the present invention and maneuver it into its usable position. In most instances two people would be required to install the present invention in front of horizontally-sliding window sashes since gravity would not favor installation as it does during placement of the present invention in front of a vertically operated double-hung window. Since neither tools nor a ladder is required for installation or removal and the opposing straps are connected to one another by quick-release fasteners, the present invention can be quickly removed if emergency egress through the double-hung window is required. The present invention can be used for storm protection on all windows of a house or used as an anti-theft device on downstairs or otherwise easily accessible windows when people are on vacation, for windows on vacant rental property, or at anytime they want an extra measure of security for their families. Bullet-proof materials and reinforcing bars can be used to further enhance the protective function of the present invention. Also, when not in use, the present invention can be folded into a compact configuration and easily stored within a nearby closet or under a bed in the room where it will be installed. Since the degree of transparency of the present invention can be selected by the homeowner, the use of transparent panels would allow the homeowner to leave the security device in place for extended periods of time and still let outside light come through the window. For example, parents may want continual protection for a window in a child's room throughout a storm season or when a child's room is on the first floor of the house, and such parents would be able to leave a transparent embodiment of the present invention in place throughout the entire anticipated duration of a storm season, or indefinitely, without significantly diminishing the amount of light entering the window and without creating a hazardous situation should emergency evacuation from the room through the window be required. The present invention is reusable, and its installation does not damage or permanently alter any part of a window, its frame, weatherstripping around the window, or the building surfaces adjacent to the window. The present invention can come in standard sizes or it can be custom-fit for connection to non-standard sizes of double-hung windows. Also, double-hung window frames could be manufactured with a larger outermost groove than is present in standard sizes of double-hung windows to allow installation of embodiments of the present invention having additional combinations of features which might cause an overall thickness exceeding one inch. Installation of the protective panels also provides a thermally insulating outer layer for double-hung windows and the panels can further comprise one-way thermal transfer materials, to either add heat to a room in a cold climate or keep afternoon sunlight from excessively heating a room in a warm climate. Further, since it is simple in design, the present invention would be cost effective to manufacture and as a result could be affordably priced for widespread homeowner use, as well as for use by tenants who might otherwise be concerned about losing a damage deposit if they were to permanently alter a window or adjacent walls by installing other types of security devices over windows.

The description herein provides preferred embodiments of the present invention but should not be construed as limiting its scope. For example, other embodiments of the folding security device for double-hung windows could have variations in the number of protective panels used; the overall size of each protective panel; the type of materials used to fabricate the protective panels; the degree of transparency of the materials used for the protective panels; the number of sheets sandwiched together to form each of the protective panels; the material from which the thin outside panels are made; the number of accordion-type folds in each thin outside panel; the number of straps attached to each protective panel; the width and thickness of the straps; the type of fasteners used to secure the hinges and straps to the protective panels; the number, size, and type of reinforcing bars used in association with the protective panels; and the type of quick-release fastener used to secure opposing straps together, other than those variations shown and described herein, may be incorporated into the present invention. Thus the scope of the present invention should be determined by the appended claims and their legal equivalents, rather than the examples given.

BRIEF DESCRIPTION OF THE DRAWINGS

FIG. 2 is a perspective view of the first embodiment of the present invention in a partially folded position, with its hinges positioned between the folding protective panels and the upper and lower straps disengaged from one another, and further with each upper strap having a quick-release clamping buckle attached near to its distal end.

FIG. 3 is a perspective view of the quick-release clamping buckle of the first embodiment of the present invention with one upper strap and one lower strap connected to opposing ends of the clamping buckle.

FIG. 4 is a side view of one of the hinges of the first embodiment of the present invention connecting the upper protective panel to the lower protective panel with arrows indicating the direction of protective panel folding, the hinge being connected to both the upper protective panel and the lower protective panel with bolts, and the hinge and the bolt heads shown being located between the two protective panels when the present invention is in its folded or partially folded configuration, while the nuts are shown being secured to the threaded ends of the bolts on the back sides of the upper protective panel and the lower protective panel.

FIG. 5 is a front view of the clamping buckle of the first embodiment of the present invention showing three rectangular holes therein through which the upper and lower straps are inserted during use, and with the clamping member of the buckle being visible through the two lowermost rectangular holes.

FIG. 6 is a side view of the clamping buckle of the first embodiment of the present invention with arrows showing the direction of movement that would occur in the top and bottom parts of the clamping member during quick-release of the buckle from a lower strap.

FIG. 7 is a back view of the clamping buckle of the first embodiment of the present invention showing the gripping bottom edge of the rearward pivoting clamping member of the buckle.

FIG. 8 is a perspective view of a second preferred embodiment of the present invention partially inserted sideways through an open double-hung window during either installation or removal, with the protective panels shown as being opaque.

FIG. 10 is a perspective view of a third embodiment of the present invention shown in a partially folded position, with both upper and lower protective panels having a three-ply configuration with several spaced-apart reinforcing bars sandwiched between two sheets of protective material, the reinforcing bars extending the full width of the protective panels, and also with the hinges positioned between the two folding protective panels, the upper and lower straps attached to the surfaces of the protective panels remote from hinge placement, and the upper and lower straps disengaged from one another.

FIG. 11 is an enlarged partial side view of a fourth embodiment of the present invention with both upper and lower protective panels having reinforcing bars and shown sandwiched between two separate more thinly profiled outside panels each having accordion-type folds that allow the outside panels to fold completely and in unison with the protective panels into a compact configuration for storage or transport, the direction of folding being shown by three arrows.

DETAILED DESCRIPTION OF PREFERRED EMBODIMENTS

Figure 1:
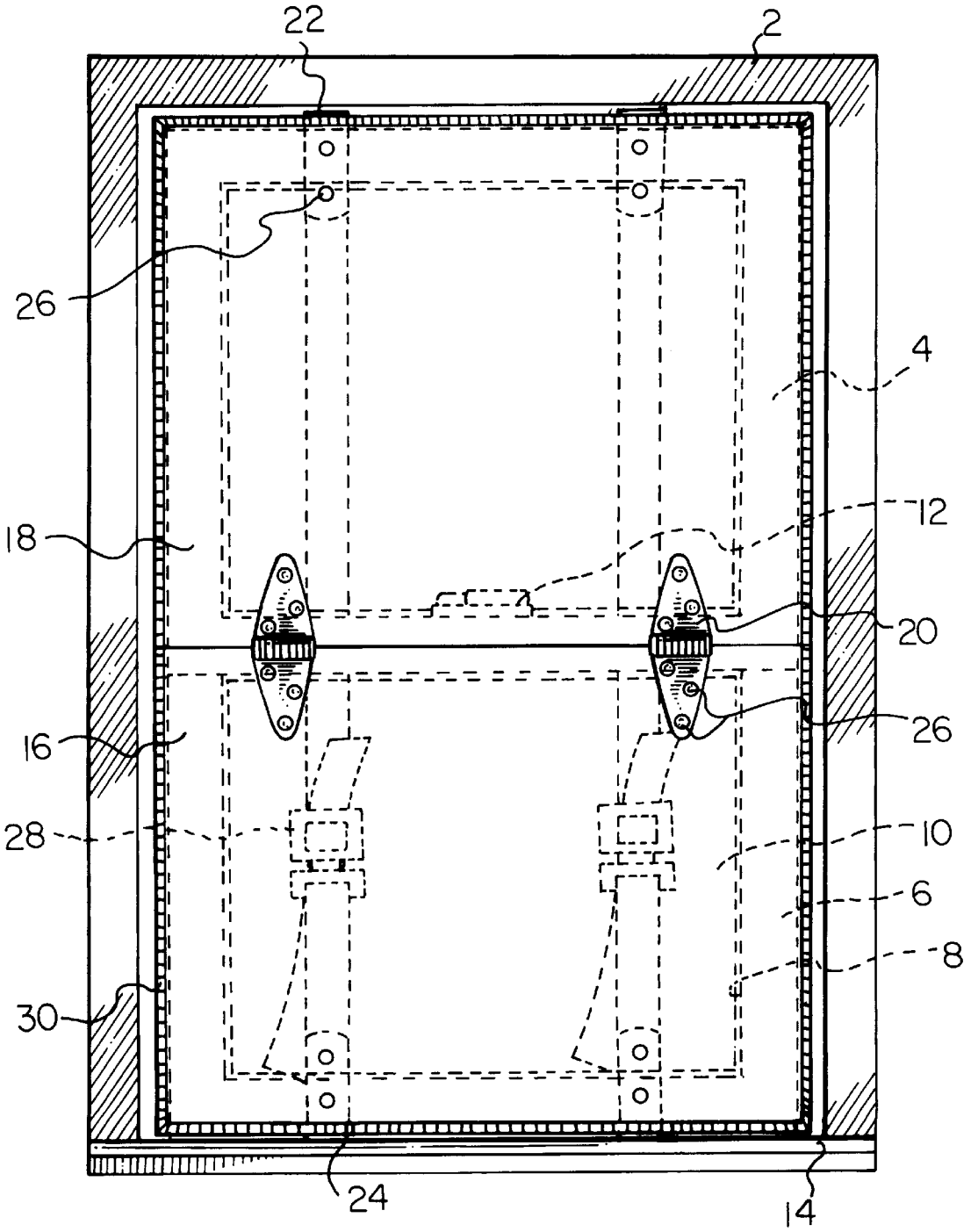
FIG. 1 is a front detailed view of a first preferred embodiment of the present invention installed within the outermost groove of a double-hung window frame and having two hinged-together protective panels positioned in front of the double-hung window sashes, with the hinges attached to the outside front surfaces of the protective panels so that they fold away from the window sashes, and with straps attached to the inside back surfaces of the protective panels, as well as opposed upper and lower straps being connected together by clamping buckles behind the window glass.

Several embodiments of the present invention are described herein which provide an additional measure of safety for double-hung windows against hazards such as inclement weather, vandalism or intruders (not shown). FIG. 1 shows a double-hung window comprising an upper sash 4 and a lower sash 6 which are positioned on separate but parallel tracks within an outer frame 2, better shown in FIG. 8. Upper sash 4 can be moved into a position below lower sash 6, but in their locked positions a substantial part of upper sash 4 is positioned above lower sash 6. Both upper sash 4 and lower sash 6 can be moved in upward and downward directions independently from each other in their separate tracks, typically with upper sash 4 moving in front of lower sash 6. Both sashes 4 and 6 have a layer of caulking material 8 to hold the glass 10 in a fixed central position within a perimeter framework traditionally made from wood. Outer frame 2 also has a downwardly and forwardly sloping window sill 14 the configuration of which is more clearly shown in FIGS. 8 and 9. A two-part window lock 12 having one part secured to the upper edge of lower sash 6 and its second part secured to the inside lower portion of upper sash 4, as more clearly shown in FIG. 12, can be used to lock upper sash 4 and lower sash 6 in a closed position relative to one another wherein the three non-locking edges of upper sash 4 and lower sash 6 each rest firmly against outer frame 2.

FIG. 1 also shows an upper protective panel 18 and a lower protective panel 16 connected together with two hinges 20. Depending upon the type of hinge used to attach upper panel 18 to lower panel 16, a minimal gap could exist between the bottom edge of upper panel 18 and the top edge of lower panel 16 and where necessary the gap having a size sufficient to allow upper panel 18 and lower panel 16 to fold essentially flat against one another into a compact configuration for storage. Upper panel 18 is positioned in front of upper sash 4 at a spaced-apart distance from the glass 10 within upper sash 4, and lower panel 16 is positioned in front of lower sash 6 at a greater spaced-apart distance from the glass 10 within lower sash 6, as better shown in FIG. 12. After installation the non-hinged edges of upper panel 18 and lower panel 16 are securely positioned within the outermost groove of outer frame 2, which is parallel to, but separate from, the track for upper sash 4, also more clearly shown in FIG. 12. Although the preferred embodiment shown in FIG. 1 utilizes two protective panels 16 and 18, it is contemplated that more than two protective panels may be used, as long as the overall size of the present invention is sufficiently large to cover both upper sash 4 and lower sash 6 while simultaneously not overly large so that the non-hinged edges of upper panel 18 and lower panel 16 cannot be easily maneuvered to fit within the outermost groove of outer frame 2.

In FIG. 1, upper panel 18 and lower panel 16 are shown as being transparent so as to protect sashes 4 and 6 while still allowing light (not shown) to pass through window glass 10. However, it is also contemplated for upper panel 18 and/or lower panel 16 to have varying degrees of transparency from translucent to opaque for, each to comprise a different degree of transparency, or even for each to comprise decorative surface markings to enhance their aesthetic appeal according to the homeowner's preference. Upper panel 18 and lower panel 16 could also have surface markings of sufficient size and composition to keep birds from flying into them and becoming injured. In the preferred embodiment shown in FIG. 1, it is contemplated for upper panel 18 and lower panel 16 to be fabricated from a resilient material such as acrylic which is lightweight and yet provides good abrasion resistant and impact strength characteristics. However, other materials, such as materials incorporating recycled plastics, are also contemplated. Upper panel 18 and lower panel 16 can each be made from a single-ply sheet or multiple sheets bonded together. Reinforcing bars 34, shown in FIGS. 10–12 can also be integrated into a single-ply sheet or sandwiched between separate or multiple sheets to form panels 16 and 18. Although not shown performing such a function, the present invention is also contemplated for protection of horizontally operating two-sash sliding windows. While gravity helps in the installation of the present invention in front of vertically operated double-hung window sashes 4 and 6 and generally allows installation by one adult of average strength and coordination unless windy conditions are present, gravity would not assist in the installation of the present invention in front of horizontally operated sliding windows, and in most instances it would take two people to perform such an installation. A large child with the strength and coordination of an average adult should be capable of at least removing the present invention during emergencies from both horizontally and vertically oriented window sashes. It is contemplated for both panels 16 and 18 to have a minimum thickness of one-half inch, however it is preferred that the minimum thickness be at least three-fourths of an inch for enhanced impact resistance against storm generated debris, vandals, and intruders. For standard sizes of double-hung windows, the outermost groove in outer frame 2 places a one-inch maximum limit on the thickness of upper panel 18 and lower panel 16. In the alternative, for custom-sized double-hung windows, the outermost groove in outer frame 2 could be made to accommodate a desired panel thickness greater than one inch. For the simplest embodiment of the present invention having only two single-ply panels each approximately one-half of an inch in thickness and dimensioned for the smallest standard perimeter dimension of a double-hung window, it is contemplated that the present invention with straps 22 and 24 attached thereto would weight approximately five pounds. It is contemplated for other simple embodiments of the present invention to weigh no more than ten pounds so that an adult of average strength and coordination could easily handle it to install and successfully remove it from the outermost groove of outer frame 2.

FIG. 1 also shows hinges 20 attached with fasteners 26 to the outside, front surfaces of upper panel 18 and lower panel 16 in such a way that upper panel 18 can be folded into a position substantially parallel to lower panel 16 for compact storage. The heads of fasteners 26 are shown positioned in front of each hinge 10. Although not shown in FIG. 1, but shown in FIG. 4, fasteners 26 extend though hinges 20 and either upper panel 18 or lower panel 16, with one hexagonal nut 32 connected to each fastener 26 to secure its threaded end to the rear surface of either panel 16 or 18. When it is anticipated that hinges 20 will be exposed to readily deteriorating forces, such as the salt spray from a beach, it is contemplated for hinges 20 to be made from corrosion-resistant materials, such as stainless steel, or to be made from other materials coated with a corrosion-resistant film. FIG. 1 shows the first embodiment of the present invention having two hinges 20, however, it is contemplated that different quantities of hinges and hinges having different configurations may also be used. FIG. 1 shows three fasteners 26 attaching each hinge 20 to lower panel 16 and an additional three fasteners 26 attaching each hinge 20 to upper panel 18, however the use of three fasteners 26 for each such connection is not critical to the present invention. In the present invention it is contemplated to have a minimum of two fasteners 26 for the attachment of each hinge 20 to a protective panel, such as upper panel 18 or lower panel 16, so that folding and unfolding forces are distributed across more than one connection point to strengthen the attachment between adjacent protective panels. Also, fasteners 26 are not limited to bolts, as shown in FIG. 1, and rivets (not shown) or other vandal and intruder-resisting means of attaching hinges 20 to panels 16 and 18 are within the scope of the present invention.

FIG. 1 also shows two upper straps 22 attached to the inside, back surface of upper panel 18, and two lower straps 24 attached to the inside, back surface of lower panel 16. At a minimum, upper straps 22 and lower straps 24 should be made from a material sufficiently strong to resist gale force winds, such as nylon, and can be manufactured from materials having a variety of colors as well as decorative patterns thereon to complement the decor of a room. Although it is contemplated for the number of upper straps 22 to be identical to the number of lower straps 24, and for each upper strap 22 to be placed into a position opposed to one lower strap 24, the total number of straps 22 and 24 used is not critical as long as the number of straps 22 and 24 is sufficient to securely maintain panels 16 and 18 in their optimally protective positions in front of upper sash 4 and lower sash 6 with the non-hinged edges of upper panel 18 and lower panel 16 hidden within the outermost groove of outer frame 2. Also, although FIG. 1 shows each upper strap 22 having two fasteners 26 connecting it to upper panel 18 and each lower strap 24 having two fasteners 26 connecting it to lower panel 16 to evenly distribute the weight of upper panel 18 and lower panel 16 during manipulation of straps 22 and straps 24 during installation and removal of the present invention from outer frame 2, it is contemplated for the connection of straps 22 and 24 to panels 18 and 16, respectively, to have more fasteners 26 per strap, but at a minimum no less than two. The heads of fasteners 26 connect hinges 20 against the front surfaces of upper panel 18 and lower panel 16 and as shown in FIG. 4 the threaded end of each fastener 26 is secured by a hexagonal nut 32 attached against the sash-facing surface of one of the upper straps 22 or one of the lower straps 24. In the preferred embodiment of the present invention shown in FIG. 1, upper straps 22 and lower straps 24 have a width dimension between approximately two and three inches and a length dimension of approximately thirty-six inches. However, the present invention is not restricted to such length and width dimensions, since the length of straps 22 and 24 would be proportioned to the combined height of upper panel 18 and lower panel 16. Also, although not shown, upper strap 22 and lower strap 24 can be bonded to the rear surfaces of panels 16 and 18, respectively, in addition to the use of fasteners 26 to strengthen the attachment of straps 22 and 24 to panels 16 and 18.

During installation of the present invention for protection of double-hung window glass 10, upper sash 4 and lower sash 6 are moved toward the center of outer frame 2 to create openings between sashes 4 and 6 and outer frame 2, and upper straps 22 and lower straps 24 are drawn through the newly created openings above upper sash 4 and below lower sash 6, respectively, to be secured to an opposing strap 22 or 24 with a clamping buckle 28. The connection of upper straps 22 to lower straps 24 is made behind window glass 10 from the inside of a building, such a house 36 shown in FIG. 13. In the preferred embodiment shown in FIG. 1, and as is more clearly shown in FIG. 2, although not limited to such attachment, it is contemplated for clamping buckle 28 to remain attached to upper strap 22 when straps 22 and 24 are separated. Also, although the present invention utilizes a clamping buckle 28 to secure upper straps 22 and lower straps 24 to one another, it is contemplated that other types of quick-release fasteners may be used to secure opposing upper straps 22 and lower straps 24 to one another, such as heavy duty hook-and-pile types of fasteners (not shown). FIG. 1 further shows the three non-hinged edges of upper panel 18 and lower panel 16 being covered by a resilient edging material 30, such as but not limited to rubber, foam, or other materials commonly used for weatherstripping purposes. The use of resilient edging material 30 is not critical to the present invention, but it prevents the non-hinged edges of panels 16 and 18 from scratching an installer (not shown) or any surface finish on outer frame 2 during their transport and handling. Resilient edging material 30 also fulfills a weatherstripping function and it improves the fit of panels 16 and 18 within the outermost groove of outer frame 2 when the present invention is retrofitted to an existing double-hung window.

FIG. 2 shows the first embodiment of the present invention in a partially folded configuration with upper panel 18 connected to lower panel 16 by two hinges 20. A connection between panels 16 and 18 having one long hinge extending the full width of panels 16 and 18, as well as a connection having more than two hinges 20, is also contemplated. FIG. 2 shows two upper straps 22 are laterally connected on the edge of upper panel 18 opposed to its hinged edge, with two lower straps 24 also laterally connected on the edge of lower panel 16 opposed to the edge connected to hinges 20. FIG. 2 also shows straps 22 and 24 positioned against the outside surfaces of panels 18 and 16 respectively, with hinges 20 being connected to the inside folded surfaces of upper panel 18 and lower panel 16. The heads of two fasteners 26 are shown positioned on the inside folded surface of lower panel 16 and used to connect lower straps 24 to the inside folded surface of lower panel 16. FIG. 2 also shows nuts 32 attached to the threaded ends of all of the fasteners 26 used for connecting both hinges 20 and upper straps 22 to upper panel 18. Although not shown, nuts 32 can have any configuration appropriate to its function of securely positioning one fastener 26 to either a hinge 20, an upper strap 22, or a lower strap 24, and then further to either upper panel 18 or lower panel 16. FIG. 2 also shows resilient edging material 30 attached to the three non-hinged perimeter edges of both upper panel 18 and lower panel 16, as well as a clamping buckle 28 attached near to the distal end of each upper strap 22. Once lower straps 24 are released from buckle 28, upper panel 18 can be folded downward to a position that is substantially parallel to lower panel 16 for insertion through outer frame 2 during installation, removal from outer frame 2, or storage. When the present invention is in the compact configuration shown in FIG. 2, it can be more easily stored in a household attic, garage, basement, under a bed, or in a closet near to the double-hung window targeted for protection.

FIG. 3 shows upper strap 22 connected through both of the rectangular openings in the top part of a clamping buckle 28, with lower strap 24 inserted through a single lower rectangular opening in the bottom part of clamping buckle 28. Although the top and bottom parts of clamping buckle 28, as well as the three openings in clamping buckle 28 are shown to have a rectangular configuration, such rectangular configurations are not critical to the present invention. In the preferred embodiment of clamping buckle 28 shown in FIG. 3, the distal end of lower strap 24 would be threaded through the front side of the bottom part of clamping buckle 28, where it would extend downwardly various distances beyond the lower edge of the bottom part of clamping buckle 28 behind the proximal end of lower strap 24. A clamping member not visible in FIG. 3, but shown in FIGS. 5–7, would securely grip the distal end of lower strap 24 to prevent it from changing length when lower strap 24 is pulled taut during use. In contrast, the distal end of upper strap 22 is threaded from the back side of clamping buckle 28 into the bottom opening in the top part of clamping buckle 28. The distal end of upper strap 22 would then be inserted from the front side of clamping buckle 28 rearwardly through the top opening in the top part of clamping buckle 28 so as to extend upwardly beyond the top part of clamping buckle 28 in front of the proximal end of upper strap 22. The size of clamping buckle 28 should correspond to the chosen widths of upper strap 22 and lower strap 24 so that upper strap 22 and lower strap 24 remain firmly fixed within clamping buckle 28 without lateral movement during use. Also, the strap fastening means of the present invention is not limited to use of the quick-release clamping buckle 28 shown in FIG. 3 and it is considered within the scope of the present invention to have other quick-release fastening means to connect each upper strap 22 to an opposing lower strap 24, as long as such strap fastening means is able to hold opposing straps 22 and 24 for extended periods of time in fixed taut positions relative to the other behind upper sash 4 and lower sash, even when the present invention is subjected to winds (not shown) approaching gale force strength so that panels 16 and 18 can remain in their optimal protective positions to protect sashes 4 and 6.

FIG. 4 shows an enlarged view of one hinge 20 of the first embodiment of the present invention connected between upper panel 18 and lower panel 16. Three fasteners 26 are positioned through each half of hinge 20 and either upper panel 18 or lower panel 16. FIG. 4 shows the heads of fasteners 26 extending beyond the inside folded surfaces of upper panel 18 and lower panel 16, with the threaded ends of fasteners 26 extending beyond the outside folded surface of either upper panel 18 or lower panel 16 and secured thereto with a hexagonal nut 32. Although FIG. 4 shows three fasteners 26 and three nuts 32 securing each half of hinge 20 to either upper panel 18 or lower panel 16, the number of fasteners 26 and nuts 32 is not critical as long as the number of fasteners and nuts is sufficient to securely hold hinge 20 against both upper panel 18 and lower panel 16. However, in the preferred embodiment it is contemplated for the present invention to have at least two fasteners 26 and two nuts 32 connecting each half of hinge 20 to either upper panel 18 or lower panel 16. Also, it is not critical for nuts 32 to be hexagonal nuts, and nuts 32 can have any configuration which fulfills the needed function of securing hinge 20 to either upper panel 18 or lower panel 16. Further, the configuration of the head of each fastener 26 is not critical, however, the heads of fasteners 26 should not extend beyond the outer surface of hinges 20 an undue amount so as to interfere with the folding of upper panel 18 and lower panel 16, and the configuration of the heads of fasteners should be such that minimizes the possibility of tampering by a potential burglar or other intruder (not shown) and removal of panels 16 and 18 from in front of window sashes 4 and 6. Neither the thickness nor the configuration of hinge 20 is critical to the present invention, however, hinge 20 should be configured to allow upper panel 18 and lower panel 16 to fold nearly flat against one another with upper panel 18 and lower panel 16 substantially parallel to each other after folding so that the present invention can be easily stored between uses.

FIGS. 5, 6, and 7 provide front, side, and back views, respectively, of the clamping buckle 28 of the first embodiment of the present invention. FIG. 5 shows clamping buckle 28 having a top part with two rectangular holes and a bottom part having a single rectangular hole with a clamping member pivotally fixed to the back side of clamping buckle 28. FIG. 6 has two arrows showing the direction of movement of the upper and lower portions of the centrally pivoting clamping member relative to the remainder of clamping buckle 28 when clamping buckle 28 is released from a lower strap 24. FIG. 7 shows the bottom edge of the pivoting clamping member having a gripping saw-toothed type of configuration for non-slip engagement with lower strap 24 to allow opposing upper straps 22 and lower straps 24 to be pulled taut behind window sashes 4 and 6 and remain taut during use. Although not shown, it is within the scope of the present invention to have any type of quick-release means other than clamping buckle 28 which can connect an upper strap 22 to an opposing lower strap 24 and maintain straps 22 and 24 firmly secured together during use, such as but not limited to a heavy duty hook-and-pile type of fastener.

Figure 9:
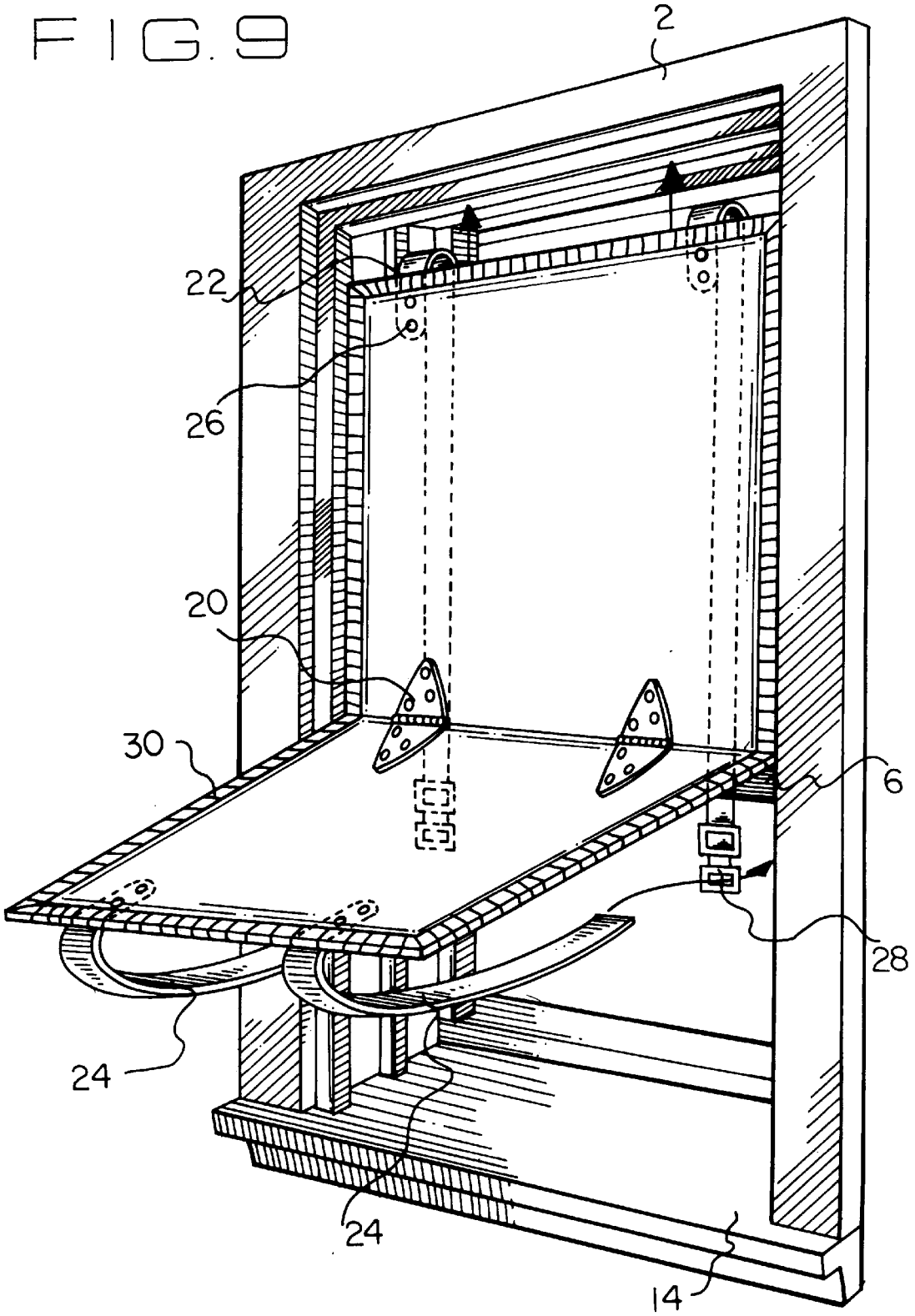
FIG. 9 is a perspective view of the first embodiment of the present invention in a nearly unfolded position during installation, with the upper protective panel approximately parallel to the upper window sash and the upper window sash prepared to close against the upper straps, the upwardly pointing arrows indicating the direction of movement for the upper window sash to place pressure on the upper straps and temporarily hold them in position against the outer window frame while subsequent steps of installation take place, and with the lower panel shown in an unfolded configuration with one arrow indicating the downward direction of movement of one of the lower straps under the lower window sash needed for the lower strap to reach a clamping buckle so that the pairs of opposed straps can become secured taut behind the upper and lower double-hung window sashes.

FIGS. 8 and 9 show a second opaque embodiment of the present invention wherein upper panel 18 and lower panel 16 are being installed in front of upper sash 4 and lower sash 6 of a double-hung window. The basic steps of installation shown in FIGS. 8 and 9 are applicable to all embodiments of the present invention. When they are removed from storage, upper panel 18 and lower panel 16 are in a folded configuration wherein each is substantially parallel to the other, with upper straps 22 each having one clamping buckle connected to its distal end and lower straps 24 disengaged from clamping buckle 28. Hinges 20 are positioned between upper panel 18 and lower panel 16 against the inside folded surfaces of panels 16 and 18, with straps 22 and 24 being laterally attached on the outside folded surfaces of upper panel 18 and lower panel 16, respectively, in opposing positions to one another. FIG. 8 also shows caulking material 8 attached to upper sash 4 and FIG. 9 shows fasteners 26 connecting upper straps 22 to the upper protective panel, shown as number 18 in FIG. 8. Although not shown, straps 22 and 24 may also be attached to panels 16 and 18 with bonding agents or adhesives to further secure attachment therebetween. Prior to installation and with both panels 16 and 18 remaining in a folded configuration and essentially parallel to one another, upper panel 18 is placed above lower panel 16. Both upper sash 4 and lower sash 6 must be moved to the center of outer frame 2 before installation to create an upper opening through which upper straps 22 can be inserted and a lower opening through which lower straps 24 can be inserted so that upper straps 22 and lower straps 24 can be drawn through the upper and lower openings and connected to one another behind upper sash 4 and lower sash 6. As shown in FIG. 8, an installer (not shown) while holding onto one of the non-hinged, non-strap bearing ends of both upper panel 18 and lower panel 16 from within the building, such as house 36 shown in FIG. 13, will insert the opposed non-hinged, non-strap bearing ends of panels 16 and 18 through the upper opening between upper sash 4 and outer frame 2, so that upper panel 18 and lower panel 16 extend beyond outer frame 2. While being manipulated and positioned fully beyond outer frame 2, the installer would grasp upper straps 22 and allow gravity (not shown) to cause lower panel 16 to unfold downwardly in front of lower sash 6 with hinges facing away from lower sash 6. The unfolded combination of panels 16 and 18 will then create an essentially planar structure in front of upper sashes 4 and lower sash 6. The upper edge of upper panel 18 is then maneuvered to fit within the outermost groove of outer frame 2. While the installer holds onto at least one upper strap 22, but preferably two upper straps 22, upper sash 4 is moved in an upward direction toward outer frame 2, as shown by the arrows in FIG. 9, until upper sash 4 contacts upper straps 22 and closes them against outer frame 2 to secure upper straps 22, as well as upper panel 18, in a substantially fixed position. Lower straps 24 can then be captured by the installer and drawn rearwardly over window sill 14 and through the opening between lower sash 6 and outer frame 2. Using lower straps 24 the bottom edge of lower panel 16, as well as the sides of both panels 16 and 18 can then be maneuvered into the outermost groove in outer frame 2 and panels 16 and 18 moved vertically and horizontally as needed to approximately center them within outer frame 2, after which lower sash 6 can be moved downwardly within its track until lower sash 6 closes on lower straps 24 to secure lower straps 24, as well as lower panel 16, in a substantially fixed position. Lock 12 can then be engaged between sashes 4 and 6 to further secure straps 22 and 24 in fixed positions against outer frame 2. The distal ends of each lower strap 24 is then inserted through the lower rectangular opening in a clamping buckle 28 attached to the distal end of an opposed upper strap 22 so that opposing straps 22 and 24 become connected vertically behind the window glass 10. Lower straps 24 are then pulled taut relative to upper straps 22 so as to provide an additional measure of security in maintaining upper panel 18 and lower panel 16 in their optimally protective positions in front of upper sash 4 and lower sash 6 to protect sashes 4 and 6 against storm debris and intruders.

Removal of the present invention from outer frame 2 is also fast and easily accomplished. The person removing panels 16 and 18 would first disengage lock 12, then move both sashes 4 and 6 away from outer frame 2 to re-create the opening between upper panel 18 and outer frame 2, as well as the second opening between lower panel 16 and outer frame 2. The installer would then activate the pivotally attached clamping members of each clamping buckle 28 to successively separate opposing straps 22 and 24 from one another. While holding onto at least one upper strap 22 when the last clamping member is pivoted, the installer would then use one or more upper straps 22, preferably at least two, to hold onto upper panel 18 while the installer turns upper panel 18 at an oblique angle relative to outer frame 2 and further reaches beyond outer frame 2 to capture one or more lower straps 24. While holding onto at least one upper strap 22 and one lower strap 24 with one hand, the installer would then grasp the near end of panels 16 and 18 directly with his or her other hand and use both hands to place panels 16 and 18 into a substantially horizontal position so that panels 16 and 18 can be drawn back through the opening between upper sash 4 and outer frame 2. Once panels 16 and 18 were substantially situated behind outer frame 2, the installer could use one hand to also move the remaining straps 22 and 24 behind sashes 4 and 6. After removal of the present invention, a screen (not shown) closure could be centrally positioned within the outermost groove of outer frame 2 in place of panels 16 and 18. As with installation, removal of the present invention can usually be performed by one person of average strength and coordination without the use of tools or a ladder. In the alternative, during emergencies the person removing the present invention could let go of upper straps 22 once upper sash 4 and lower sash 6 have been moved away from outer frame 2, and cause the present invention to fall to the ground surface below the double-hung window. Easy removal of the present invention also makes panels 18 and 16 easier to clean than permanently installed storm windows (not shown).

FIG. 10 shows a third embodiment of the present invention having upper panel 18 and lower panel 16 each with a three-ply construction consisting of a plurality of reinforcing bars 34 sandwiched between inner and outer impact-resistant layers of material, such as PLEXIGLAS®. It is also contemplated that bars 34 can be integrated into the structure of upper panel 18 and lower panel 16 when they are made from one-ply sheets. The number, type, configuration, and size of reinforcing bars 34 can vary, but preferably bars 34 extend the full width of upper panel 18 and lower panel 16. FIG. 10 shows upper panel 18 and lower panel 16 in a partially folded configuration so that hinges 20 are positioned between upper panel 18 and lower panel 16, and straps 22 and 24, as well as nuts 32, are secured to the outside folded surfaces of upper panel 18 and lower panel 16. Bars 34 provide an additional measure of security to a home, since bars 34 act to make it more difficult for storm debris, vandals, and intruders to break through upper panel 18 and lower panel 16. Although FIG. 10 shows bars 34 in their preferred substantially horizontal position within panels 16 and 18, it is also contemplated for bars 34 to be placed in alternative spaced-apart orientations, such as vertically intersecting with one another in a latticed configuration, or at oblique angles relative to the perimeter edges of upper panel 18 and lower panel 16. The configuration and attachment of hinges 20, upper straps 22, lower straps 24, and resilient edging material 30 to panels 16 and 18, as well as the attachment of clamping buckles 28 to lower straps 24, is contemplated to be the same as in previously disclosed embodiments. Resilient edging material 30 is shown to cover the non-hinged edges of panels 16 and 18, and extend a predetermined distance over both their inside and outside folded surfaces of both panels 16 and 18. The extension of resilient edging material 30 must be sufficient to allow resilient edging material 30 to remain securely in place to fulfill its function, that of preventing the protected edges from injuring an installer (not shown) or from scratching the finished surface of sashes 4 and 6, or outer frame 2, during installation and other handling of the present invention.

FIG. 11 illustrates the center portion of a fourth embodiment of the present invention wherein the three-ply construction of FIG. 10 is further encased between two thinly profiled outside panels 40, each having a plurality of centrally located accordion-type folds 42 adjacent to hinge 20. Although not shown, it is contemplated for the non-visible extensions of both outside panels 40 to have a planar configuration that is positioned substantially parallel to both upper panel 18 and lower panel 16. It is also contemplated for both outside panels 40 to be made from materials that would protect hinges 20, fasteners 26, and nuts 32 from rust, corrosion, vandalism, and tampering by potential intruders, as well as protect an installer (not shown) from being scratched by fasteners 26 or nuts 32 while handling upper panel 18 and lower panel 16. It is contemplated that folds 42 directly facing hinge 42 will condense when the present invention is folded for installation, removal, and storage. In contrast, it is contemplated that folds 42 which are remote from hinge 20 will expand around upper panel 18 and lower panel 16 when the present invention is folded. The number of folds 42 is not critical, but it is contemplated in the preferred embodiment for the number of folds 42 on the outside panel 40 directly facing hinges 20 to be less than the number of folds 42 on the outside panel 40 remote from hinges 20. Outside panels 40 may be secured to the perimeter edges of panels 16 and 18 with bonding agents, or secured by similar attachment to resilient edging material 30. FIG. 11 shows fasteners 26, nuts 32, and hinge 20, as well as the hinged edges of panels 16 and 18, all positioned between folds 42. In the preferred embodiment, although not critical, it is contemplated for the outside panels 40 to be made from a thin tear-resistant plastic, perhaps even recycled material. Outside panels 40 may be transparent, translucent, or opaque. Outside panels 40 may also be made from colored materials, as well as materials having surface decoration.

Figure 12:
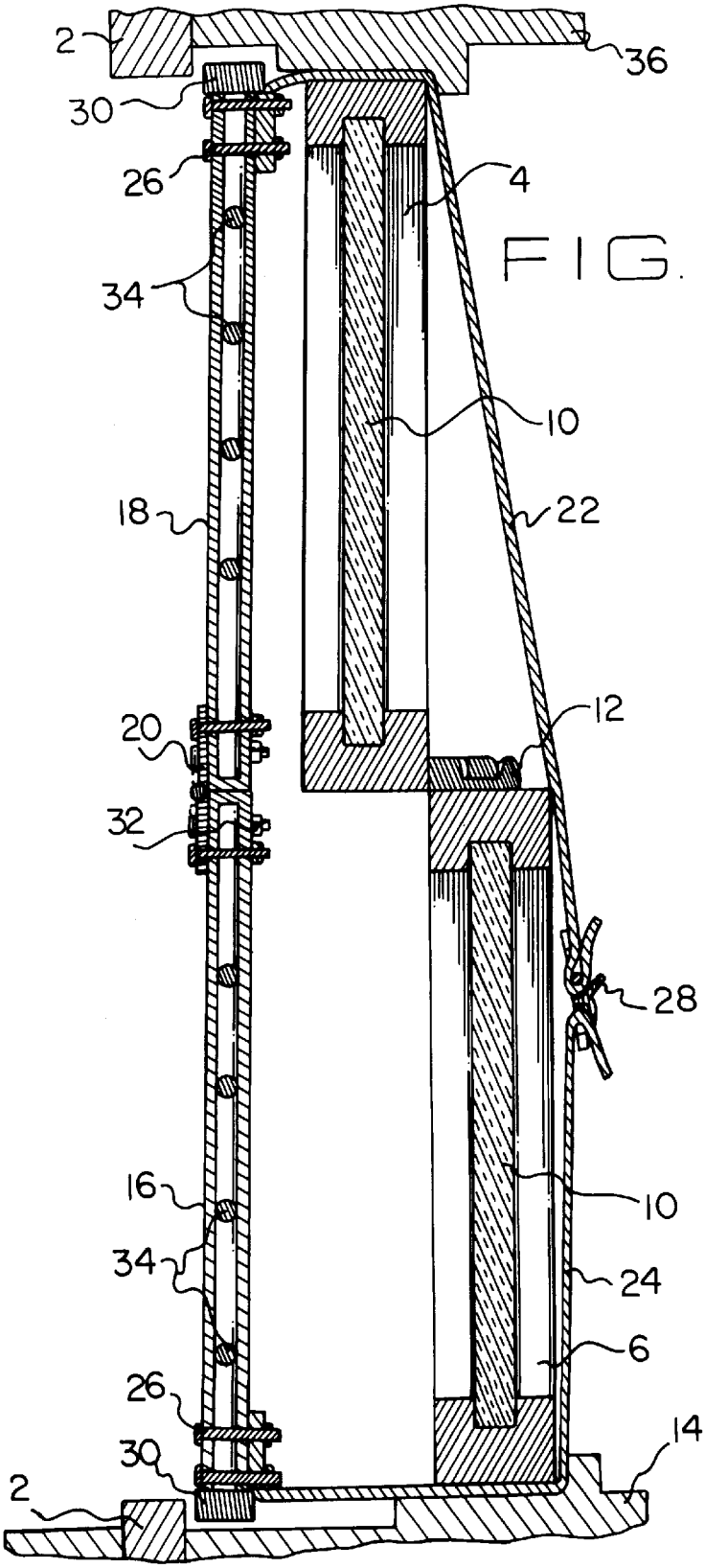
FIG. 12 is a full side view of the protective panels having reinforcing bars and positioned within the outermost groove of a double-hung window frame in front of the double-hung window sashes, with the upper and lower window sashes being locked in a closed position relative to one another, and opposed upper and lower straps fastened to one another in a taut configuration behind the window sashes by a clamping buckle.

FIG. 12 shows the present invention secured within the outermost groove in outer frame 2, in front of upper sash 4 and lower sash 6, where a screen (not shown) might otherwise be positioned for use. Window glass 10 is shown centered within both upper sash 4 and lower sash 6. Upper strap 22 is inserted between the uppermost part of outer frame 2 and the top surface of upper sash 4, with upper sash 4 closed against upper strap 22 to secure upper strap 22 against outer frame 2 while set within the wall structure of house 36. Similarly, lower strap 24 is inserted between the window sill 14 of outer frame 2 and the bottom surface of lower sash 6, with lower sash 6 closed against lower strap 24 to secure lower strap 24 against window sill 14. Although for simplicity window sill 14 is illustrated in FIG. 12 to have a substantially horizontal orientation, in actuality window sill 14 would have the forwardly and downwardly sloping configuration shown in FIGS. 8 and 9. Also, as an extra measure of security, lock 12 is engaged to prevent movement of upper sash 4 relative to lower sash 6 while the present invention is in place. Strap 22 and 24 are connected together with clamping buckle 28 and pulled taut behind upper sash 4 and lower sash 6. In addition, FIG. 12 shows bars 34 in spaced-apart positions within upper panel 18 and lower panel 16, with resilient edging material 30 positioned on the upper and lower edges of upper panel 18 and lower panel 16, respectively. The number of bars 34 used in panels 16 and 18 should be sufficient to provide the level of protection desired by the user, but not exceed the number that would make panels 16 and 18 too heavy to be easily maneuverable. Upper strap 22 is connected by fasteners 26 to upper panel 18, on the back side of upper panel 18 between upper panel 18 and upper sash 4, near to the upper edge of upper panel 18. Similarly, lower strap 24 is connected by fasteners 26 to lower panel 16, on the back side of lower panel 16 between lower panel 16 and lower sash 6, near to the lower edge of lower panel 16. FIG. 12 shows panels 16 and 18 having essentially identical height dimensions with hinge 20 connected between the lower edge of upper panel 18 and the upper edge of lower panel 16. However, it is also within the scope of the present invention for the height dimensions of panels 16 and 18 to be different, particularly when the present invention has more than two protective panels so that all of the protective panels can fold together into a compact configuration for storage. FIG. 12 shows all nuts 32 attached to fasteners 26 holding hinge 20, upper strap 22, and lower strap 24 against panels 16 and 18 in positions located between panels 16 and 18 and sashes 4 and 6, respectively, so as to be inaccessible to a person outside of house 36 attempting to remove the present invention from its protective position.

Figure 13:
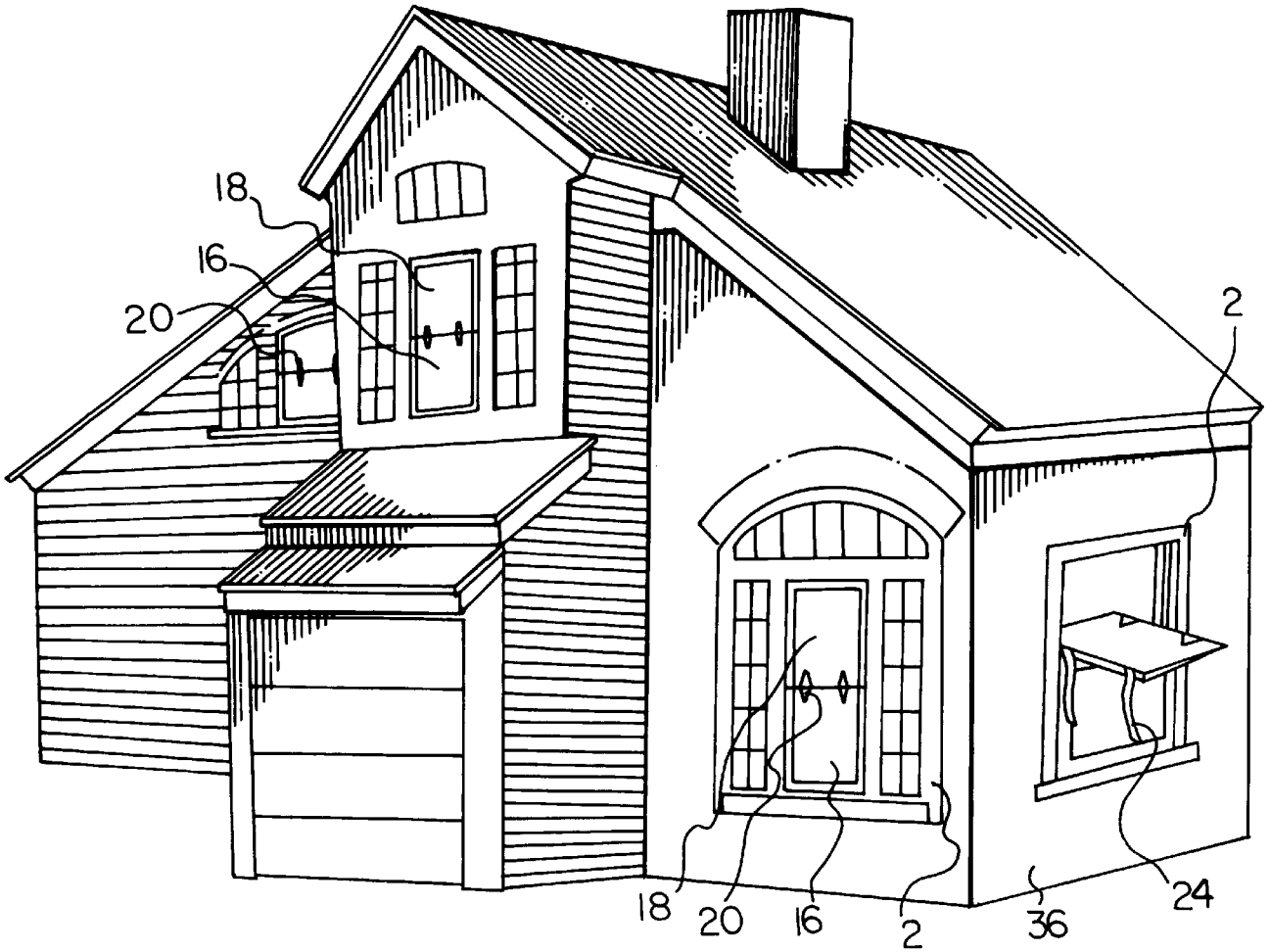
FIG. 13 is a perspective view of a house with both upstairs and downstairs windows protected by the present invention.

FIG. 13 shows three present invention devices having upper panel 18, lower panel 16, and two hinges 20 installed over two upstairs windows and one downstairs double-hung window in house 36 to protect house 36 from intruders attempting to gain entry through the double-hung windows. FIG. 13 also shows a fourth present invention device during installation or removal from outer frame 2, with lower straps 24 separated from upper straps 22. Although it is contemplated for transparent embodiments of the present invention to be used for storm debris protection over upstairs windows in house 36, and for translucent or opaque embodiments of the present invention to be used for protection against intruders, any combination of present invention embodiments can be used to cover the windows on house 36, including those comprising bullet-proof materials and bars 34. Also, the present invention can be made in standard dimensions to protect commonly used sizes of double-hung windows, or custom made to fit non-standard sizes of windows. The present invention would also be successful in protecting double-hung windows that are secured in a bay window configuration since no separate hardware would be required on the bay window frame. Installation of the present invention is rapid and no professional person is required, only an adult of average strength and coordination. Once the protective panels, such as upper panel 18 and lower panel 16, are lowered into position, in the preferred embodiment, simple clamping buckles 28 or other quick-release fasteners (not shown), such as heavy duty hook-and-pile fasteners, are used to connect each upper strap 22 to an opposing lower strap 24. Since the present invention is purchased once and reused many times with little refurbishment between uses, and without damage or alteration to the windows or walls of house 36, the present invention is a cost effective way in which to protect double-hung windows.

Figure 14:
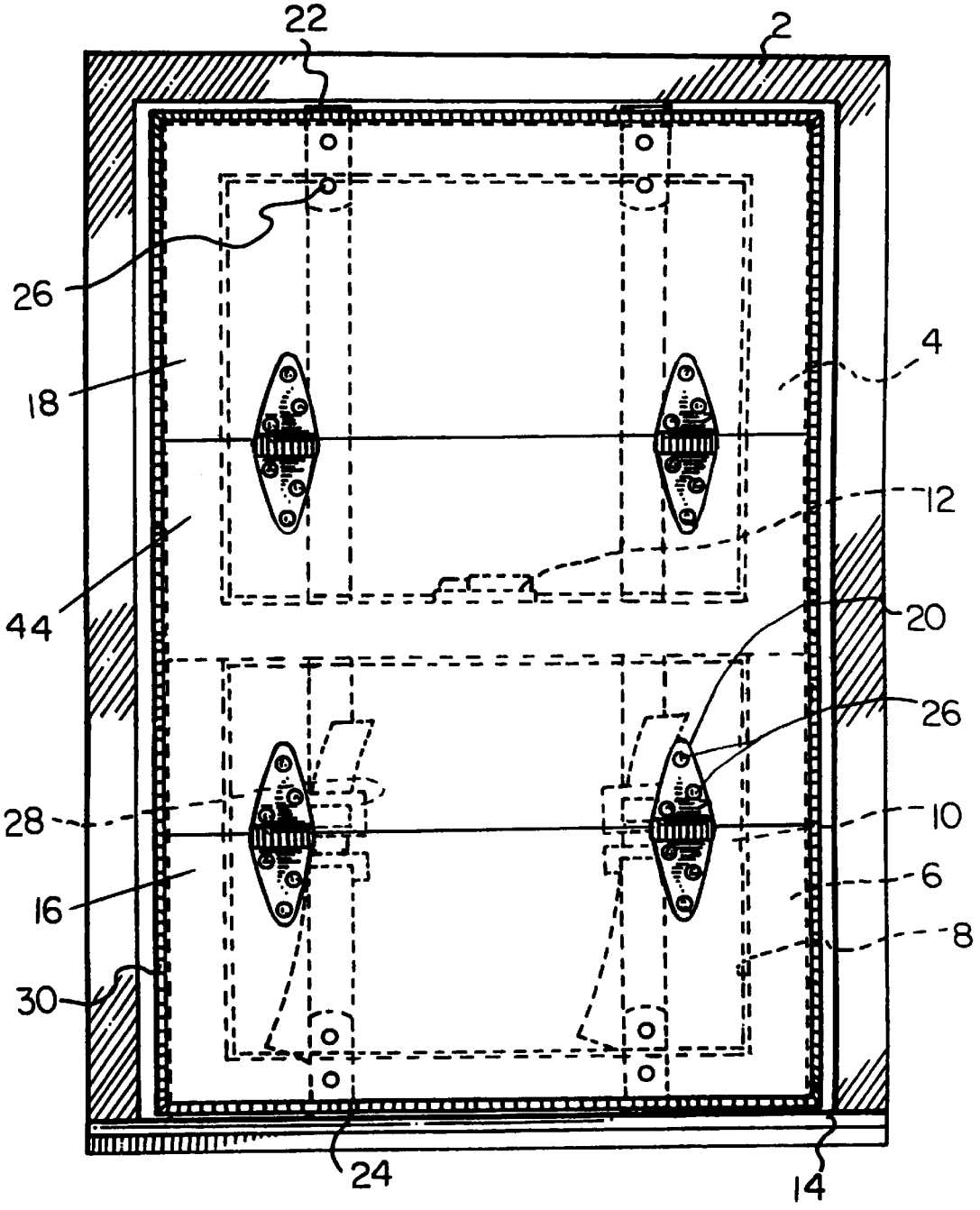
FIG. 14 is a front view of a fifth embodiment of the present invention having three hinged together protective panels.

FIG. 14 shows a fifth embodiment of the present invention having three protective panels, an upper protective panel 18, a middle protective panel 44, and a lower protective panel 16 positioned in front of a double-hung window comprising an upper sash 4, a lower sash 6, an outer frame 2, glass 10, caulking material 8, and a window lock 12 securing upper sash 4 in a fixed position relative to lower sash 6. Two hinges 20 connect the bottom edge of upper protective panel 18 to the top edge of middle protective panel 44. A second pair of hinges 20 connects the bottom edge of middle protective panel 44 to the top edge of lower protective panel 16. Fasteners 26 connect hinges 20 to upper protective panel 18, middle protective panel 44, and lower protective panel 16. Although FIG. 14 shows upper protective panel 18, middle protective panel 44, and lower protective panel 16 all having approximately the same dimension and configuration, it is considered within the scope of the present invention for upper protective panel 18, middle protective panel 44, and lower protective panel 16 to have different height dimensions. FIG. 14 further shows resilient edging material 30 attached to the non-hinged edges of upper protective panel 18, middle protective panel 44, and lower protective panel 16, with the bottom edge of resilient edging material 30 positioned against window sill 14. In addition, FIG. 14 shows two upper straps 22 each connected to an opposed lower strap 24 with a buckle 28 and pulled taut behind glass 10 ready for use. Installation and removal of the fifth embodiment shown in FIG. 14 is similar to that of the first embodiment shown in FIG. 1, with gravity being used to assist the unfolding of middle protective panel 44 and lower protective panel 16, and their positioning in front of lower sash 6.

What is claimed is:

1. A foldable security device for protecting against storm-related damage, vandalism, and unauthorized entry, a double-hung window with an upper sash, a lower sash, and an outer frame having an outermost groove, said device comprising a plurality of rigid, abrasion-resistant, and high impact strength protective panels each having an essentially rectangular and planar configuration, a minimum thickness of approximately one-half inch, a top edge, opposed side edges, a bottom edge, and a back surface, each of said protective panels also being aligned with and attached to the remainder of said protective panels so that each of said protective panels is connected to at least one of the remainder of said protective panels and said protective panels can be placed into a compactly folded configuration wherein each of said protective panels is positioned essentially parallel to the remainder of said protective panels and collectively all of said protective panels can be opened into an essentially flat configuration for use, with one of said protective panels being an uppermost protective panel having a non-connected top edge, and also with one of said protective panels being a lowermost protective panel having a non-connected bottom edge, said protective panels also having a connected length and width dimension that is slightly larger than the dimension of the outermost groove of the double-hung window intended for protection so that said protective panels remain within the outermost groove during use at a spaced-apart distance from the upper and lower sashes, and wherein each of said protective panels comprise a plurality of reinforcing bars;

a first connection means attaching said top edge of said lowermost protective panel, said bottom edge of said uppermost protective panel, and said top and bottom edges of the remainder of said protective panels to a next adjacent one of said protective panels, said first connection means adapted for secure connection of adjacent ones of said protective panels and for allowing said protective panels collectively to be placed into said compactly folded configuration;

a plurality of flexible straps, each of said straps having a proximal end and a distal end, with one-half of said straps being upper straps and one-half of said straps being lower straps, said proximal ends of each of said upper straps being attached to said back surface of said uppermost upper protective panel near to said top edge of said uppermost protective panel, and said proximal ends of each of said lower straps being attached to said back surface of said lowermost protective panel near to said bottom edge of said lowermost protective panel in a position opposed to one of said upper straps, the length dimension of said straps being such that the combined length of each of said upper straps and the one of said lower straps positioned opposite thereto allows said upper strap and said lower opposed strap to become connected taut to one another behind the upper and lower sashes of the double-hung window when the upper and lower sashes are in their closed and locked positions, and while taut allowing said upper strap and said lower strap to remain positioned entirely behind said protective panels;

a second connection means for connecting said distal end of one of said upper straps to said distal end of an opposed one of said lower straps, said second connection means adapted for providing a strong non-slip connection between opposing ones of said upper and lower straps, said second connection means also being adapted for providing a quick-release connection between opposing ones of said upper and lower straps; and a third connection means for connecting each of said proximal ends of said upper straps to said back surface of said uppermost protective panel near to said top edge of said uppermost protective panel and connecting each of said proximal ends of said lower straps to said back surface of said lowermost protective panel near to said bottom surface of said lowermost protective panel, said third connection means adapted for providing a fixed strong connection between said protective panels and each of said straps;

whereby when said top edges and said side edges of said uppermost protective panel, said bottom edge and said side edges of said lowermost protective panel, and said side edges of the remainder of said protective panels are placed within the outermost groove of a double-hung window and the upper and lower sashes of the double-hung window are placed in their closed and locked positions against the outer frame, said upper straps will become fixed securely against the outer frame by the upper sash and said lower straps will become fixed securely against the outer frame by the lower sash, and opposing ones of said upper and lower straps will be connected taut to one another by said second connection means behind the upper and lower sashes so that the outermost groove, the closed and locked upper and lower sashes, and said taut straps all work together to help to retain said upper and lower protective panels in a fixed position in front of the upper and lower sashes and at spaced-apart distances therefrom.

2. The device of claim 1 wherein said reinforcing bars are selected from a group consisting of reinforcing bars directly integrated into a single-ply sheet, and reinforcing bars centrally positioned between two sheets as part of a three-ply sheet construction.

3. The device of claim 1 further comprising two outer panels each with centrally positioned accordion-type folds, said protective panels positioned between said outer panels, with said outer panels protecting said first and third connection means from excessive deterioration as well as from injuring surrounding objects during movement of said protective panels, said accordion-type folds being configured to facilitate maneuvering of said outer panels and said protective panels into said compactly folded configuration.

4. The device of claim 1 wherein said protective panels each have a front surface and said first connection means connects said front surfaces of adjacent ones of said protective panels to one another.

5. The device of claim 1 wherein said first connection means comprises a plurality of hinges.

6. The device of claim 5 wherein said third connection means is selected from a group consisting of nuts and bolts, rivets, bonding agents, and adhesive materials.

7. The device of claim 1 further comprising edge protection means for said top edges and said side edges of said uppermost protective panel, said bottom edge and said side edges of said lowermost protective panel, and said side edges of the remainder of said protective panels.

8. The device of claim 1 wherein said protective panels are selected from a group consisting of transparent acrylic panels, translucent acrylic panels, and opaque acrylic panels.

9. The device of claim 1 wherein said second connection means is selected from a group consisting of quick-release buckles, clamping buckles, and heavy duty hook-and-pile fasteners.

10. The device of claim 1 wherein said protective panels are selected from a group consisting of bullet-proof panels, one-way thermally conductive panels, color enhanced panels, and decoratively enhanced panels.

11. A method for protecting double-hung windows from unauthorized entry and damage due to storm debris and vandalism, said method comprising the steps of providing a double-hung window with an upper sash, a lower sash, and an outer frame having an exterior surface and an outermost groove adjacent to said exterior surface; a plurality of essentially planar protective panels each with a top edge, side edges, a bottom edge, a front surface, and a back surface; a plurality of hinges; a plurality of flexible straps each with opposed distal and proximal ends; and a plurality of quick-release fasteners;

aligning said protective panels in a single layer with said top edges of one of said protective panels positioned adjacent to said bottom edge of the next adjacent one of said protective panels;

connecting adjacent ones of said protective panels to one another with said hinges so that said hinges are attached between said front surfaces so as to create two opposed endmost protective panels each with a non-hinged edge;

connecting said proximal end of one-half of said straps to said back surface of the first of said endmost protective panels near to said non-hinged edge;

connecting said proximal end of the other one-half of said straps to the second of said endmost protective panels near to said non-hinged edge and in positions allowing those of said straps attached to said second endmost panel to each oppose one of said straps attached to said first endmost protective panel;

folding said protective panels successively on top of one another into a compact configuration so that said first endmost protective panel is on top, said hinges of said first endmost protective panel are positioned between protective panels, and said distal ends of said straps attached to at least said first endmost protective panel are easily accessible;

and wherein the steps of installing said protective panels in front of said double-hung window comprises moving both said upper sash and said lower sash away from said outer frame to create an upper opening between said outer frame and said upper sash, as well as a lower opening between said outer frame and said lower sash;

while holding at least one of said straps connected to said first endmost protective panel and also holding the remainder of said protective panels directly, inserting one of said side edges of each of said protective panels through said upper opening and beyond said exterior surface of said outer frame;

when said protective panels are positioned fully beyond said exterior surface, grasping at least two of said straps attached to said first endmost protective panel and allowing gravity to cause the remainder of said protective panels to unfold downwardly in front of said upper and lower sashes with said hinges facing away from said lower sash and cause said straps connected to said first endmost protective panel to become upper straps and said straps connected to said second endmost protective panel to become lower straps;

while holding said upper straps, maneuvering said top edge and said side edges of said first endmost protective panel to fit within said outermost groove;

grasping and holding all of said distal ends of said upper straps behind said upper sash;

moving said upper sash in an upward direction toward said outer frame until said upper sash contacts said upper straps and closes them against said outer frame to secure said upper straps in a substantially fixed position relative to said outer frame, with said distal ends of said upper straps remaining positioned behind said upper sash;

capturing and holding said distal ends of said lower straps;

drawing said distal ends of said lower straps away from said exterior surface and rearwardly through said second opening between said lower sash and said outer frame;

using said lower straps to maneuver said bottom edge and said sides edges of said second endmost protective panel into said outermost groove to approximately center said protective panels within said outer frame;

grasping and holding all of said distal ends of said lower straps behind said lower sash;

moving said lower sash downwardly toward said outer frame to cause said lower sash to close against and secure said lower straps in a fixed position relative to said outer frame, with said distal ends of said lower straps remaining positioned behind said lower sash;

connecting each of said quick-release fasteners between said distal ends of opposing ones of said upper and lower straps; and placing opposing one of said upper and lower straps each in a taut condition behind said upper and lower sashes;

and wherein removal of said protective panels from in front of said sashes comprises the steps of moving said upper sand lower sashes away from said outer frame to re-create said upper and lower openings;

separating opposing ones of said upper and lower straps from one another;

while holding at least one of said upper straps and said side edge of said first endmost protective panel turning said first endmost protective panel at an oblique angle relative to said outer frame;

reaching beyond said outer frame to capture said distal end of at least one of said lower straps;

while holding at least one of said upper straps and at least one of said lower straps and also holding the remainder of said protective panels directly, folding said protective panels into said compact configuration;

placing said protective panels into a substantially horizontal position; and drawing said protective panels rearwardly through said upper opening between said upper sash and said outer frame and behind said upper and lower sashes.

12. The method of claim 11 wherein said step of providing quick-release fasteners is selected from a group consisting of the providing of quick-release buckles, the providing of clamping buckles, and the providing of hook-and-pile fasteners.

13. The method of claim 11 further comprising the steps of providing a quantity of edge protection materials and applying said edge protection materials around said top edges and said side edges of said first endmost protective panel, said bottom edge and said side edges of said second endmost protective panel, and said side edges of the remainder of said protective panels.

14. The method of claim 11 wherein said step of providing protective panels further comprises the step of providing a plurality of protective panels made from acrylic materials.

15. The method of claim 14 wherein said step of providing acrylic protective panels is selected from a group consisting of the providing of transparent acrylic panels, the providing of translucent acrylic panels, and the providing of opaque acrylic panels.

16. The method of claim 11 wherein said step of providing protective panels is selected from a group consisting of the providing of protective panels having reinforcing bars directly integrated into a single-ply sheet, and the providing of protective panels having reinforcing bars centrally positioned between two sheets as part of a three-ply sheet construction.

17. The method of claim 14 wherein said step of providing protective panels is selected from a group consisting of the providing of bullet-proof materials, the providing of one-way thermally conductive materials, the providing of color enhanced materials, and the providing of decoratively enhanced materials.

18. The method of claim 11 further comprising the step of providing two tear-resistant and corrosion-resistant outer panels each with centrally positioned accordion-type folds, and the step of positioning said protective panels between said outer panels.

* * * * *